US005170810A

United States Patent [19]

Chapin

[11] Patent Number: 5,170,810

[45] Date of Patent: Dec. 15, 1992

[54] SLIDING TRAY ASSEMBLY

[76] Inventor: Margaret T. Chapin, 10000 Four Mile Creek Rd., Charlotte, N.C. 20277

[21] Appl. No.: 891,192

[22] Filed: Jun. 1, 1992

[51] Int. Cl.[5] ..... A45B 3/00

[52] U.S. Cl. ..... 135/66; 135/67; 224/281; 108/47; 297/5

[58] Field of Search ..... 135/65-67; 297/5, 6; 224/281, 42.32, 42.43, 42.44; 108/143, 43, 47, 48

[56] References Cited

U.S. PATENT DOCUMENTS

| | | | |
|---|---|---|---|
| 2,270,557 | 1/1942 | Randall | 224/281 X |
| 2,292,797 | 8/1942 | Roberts | 108/143 X |
| 2,430,235 | 11/1947 | Mendenhall | 135/67 |
| 2,825,611 | 3/1958 | Aynesworth | 224/42.44 X |
| 2,946,638 | 7/1960 | Colo | 108/143 X |
| 3,111,916 | 11/1963 | Bjerke | 108/157 X |
| 3,957,071 | 5/1976 | Kenner | 135/67 X |
| 4,074,683 | 2/1978 | Di Chiang | 135/67 |
| 4,452,484 | 6/1984 | Pastor | 297/6 |
| 4,708,274 | 11/1987 | Roche | 224/42.43 X |
| 4,811,875 | 3/1989 | DiSimone | 224/42.44 |
| 4,826,058 | 5/1989 | Nakayama | 224/42.44 |
| 4,830,243 | 5/1989 | Mann | 135/65 X |
| 4,907,839 | 3/1990 | Rose et al. | 135/67 X |
| 4,946,058 | 8/1990 | Stamm | 220/23.83 |
| 5,052,728 | 10/1991 | Fukumoto | 224/281 X |

FOREIGN PATENT DOCUMENTS

| | | | |
|---|---|---|---|
| 1282417 | 12/1961 | France | 224/281 |

*Primary Examiner*—Richard E. Chilcot, Jr.
*Assistant Examiner*—Lan Mai
*Attorney, Agent, or Firm*—Richard P. Matthews

[57] ABSTRACT

A sliding tray assembly is disclosed comprising a pair of spaced support rails which are interconnected by means of a connecting bar and which can be easily secured to a pair of spaced, substantially upright legs of a walker or other like object. The tray assembly itself is attached to the legs so as to extend forwardly thereof in order to prevent the tray assembly form obstructing the use of the object. The tray assembly further includes a pair of guide rail members which are respectively secured to the spaced support rails. The guide rails define guide channels within which a tray is removably, slidably mounted. The tray can be selectively secure within the channels along the length of the guide rails to position the tray in various operating positions.

20 Claims, 3 Drawing Sheets

SLIDING TRAY ASSEMBLY

BACKGROUND OF THE INVENTION

1. Field of the Invention

The present invention pertains to a sliding tray assembly and, more particularly, a sliding tray assembly for attachment to and use with a walker or the like.

2. Discussion of the Prior Art

Many medical patients, elderly people, and the like need aid in moving about. Walkers are widely known aids for the aged, handicapped, injured or other individuals who require some stabilization while walking. When using a walker, both hands of the individual are needed in order to move the walker itself with each step taken. Therefore, it can be extremely difficult, if not impossible, for walker users to carry other items with them.

In order to solve this problem, it has heretobefore been proposed to attach a shelf, basket or tray to a walker which can support the items to be transported. For example, U.S. Pat. No. 3,957,071 discloses a carrier attachment for a walker. The carrier is pivotally attached to the walker and includes a pocket for receiving articles to be transported. The carrier can be moved with respect to the walker so that it can be placed upon the top rails of the walker to act as a tray. Unfortunately, while in this position, the carrier covers the handles of the walker and is located rather high if the walker is to be used as a tray table, such as when placed in front of a chair.

The tray arrangement for use with a walker, as disclosed in U.S. Pat. No. 4,074,683, is secured to and extends forward of the front of the walker. This position is beneficial when the walker is used as a tray table, but also limits the weight of the items it can support since, if heavy objects are placed therein, the walker may topple over. In addition, the tray must be displaced vertically with respect to the walker in order to detach the tray from the walker. This can be difficult for an injured or elderly person since it requires one to lean forward and lift up on the tray.

In U.S. Pat. No. 4,708,274, a tray apparatus is disclosed which can be removably secured to a walker below the level of and between the handle portions of the walker. This position enables rather heavy objects to be transported on the tray due to its location with respect to the support legs of the walker, however, the positioning of a tray in this manner may interfere with the use of the walker since the movement of the user's legs can be obstructed by the tray. In addition, if the arrangement is used as a tray table, the vertically angled legs of the walker limits how close the tray can be positioned with respect to the user.

Therefore, there exists a need in the art for a tray assembly that can be easily attached to a walker or the like and which can be selectively positioned relative to the walker so as to enable it to transport rather heavy objects and to be movable to a position forward of the walker so that the walker can be used as a tray table and to prevent potential obstruction with the use of the walker. In addition, there exists a need for a tray assembly that can be readily detached from a walker or the like in a convenient manner.

SUMMARY OF THE INVENTION

It is an object of the present invention to provide a tray assembly that can be easily attached to a walker or the like without obstructing its use. It is a further object of the present invention to provide a tray assembly that includes a tray which may be selectively shifted with respect to and readily detached from a walker or the like.

These and other objects of the present invention are realized by providing a tray assembly comprising a pair of spaced support rails which are interconnected by means of a connecting bar and which can be easily secured to a pair of spaced, substantially upright legs of a walker or other like object. The tray assembly itself is attached to the legs so as to extend forwardly thereof in order to prevent the tray assembly from obstructing the use of the object. The tray assembly further includes a pair of guide rail members which are respectively secured to the spaced support rails. The guide rails define guide channels within which a tray is removably, slidably mounted. In addition, means are provided to selectively secure the tray within the channels along the length of the guide rails.

Additional objects, features and aspects of the invention will become more readily apparent from the following detailed description of a preferred embodiment of the invention when taken in conjunction with the drawings wherein like reference numbers refer to corresponding elements in the several views.

DETAILED DESCRIPTION OF A PREFERRED EMBODIMENT

Figure 1:
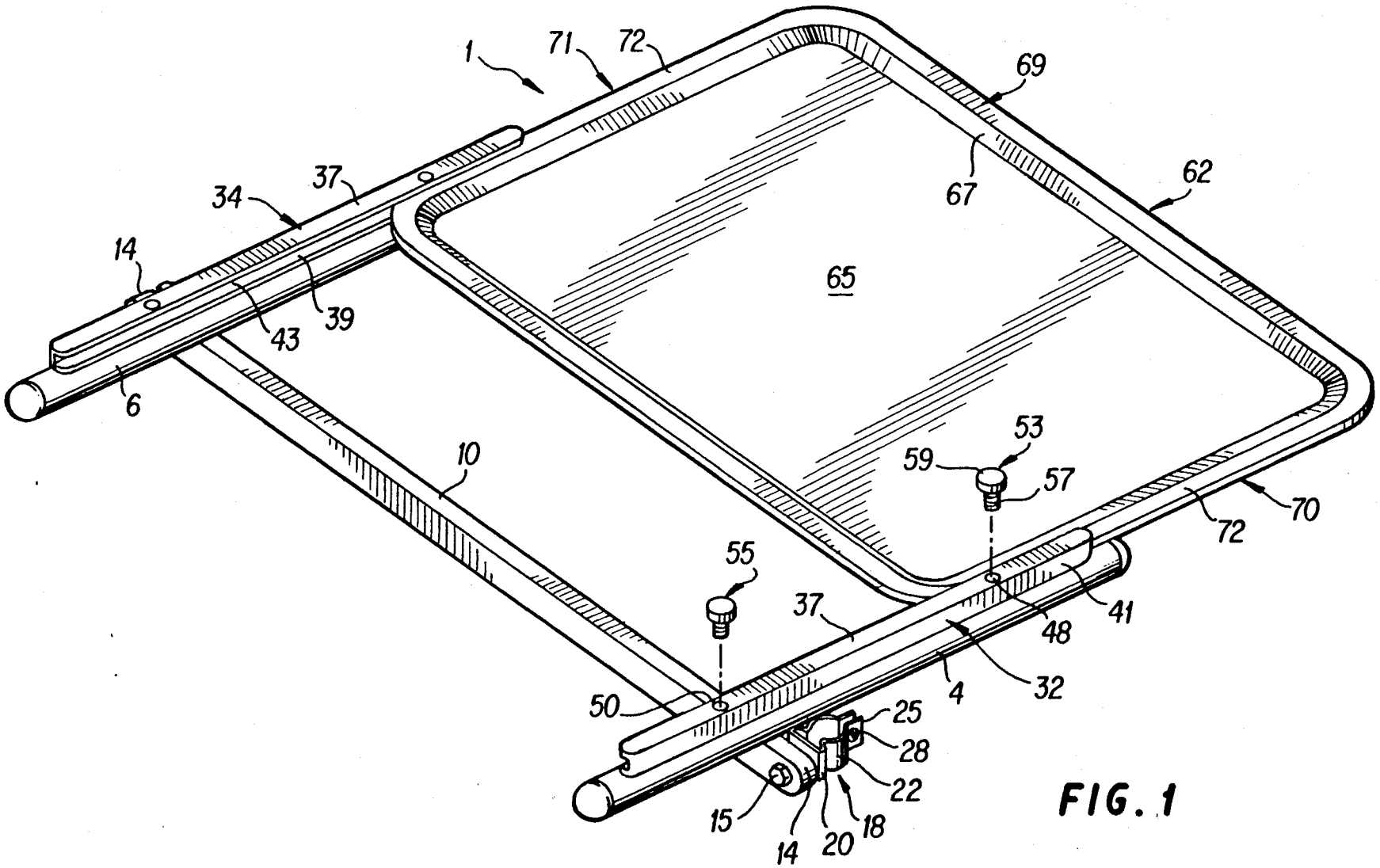
FIG. 1 is a perspective view of the sliding tray assembly according to a preferred embodiment of the invention.
Figure 2:
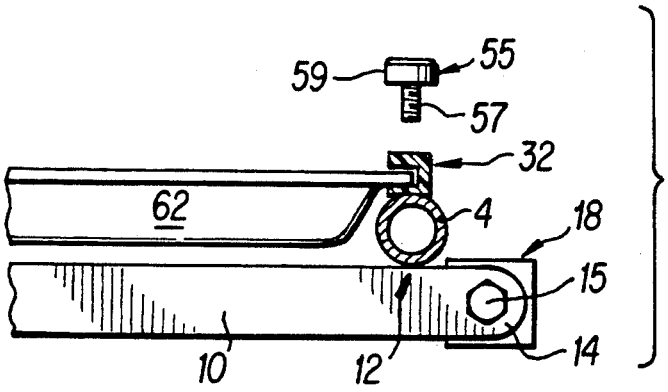
FIG. 2 depicts a rear plane view of a portion of the tray assembly shown in FIG. 1.

With initial reference to FIGS. 1 and 2, the sliding tray assembly of the present invention is generally indicated at 1 and comprises a pair of spaced, substantially parallel support rails 4,6 which are interconnected by a connecting bar 10. In the preferred embodiment, support rails 4 and 6 and connecting bar 10 are formed from metal, such as aluminum, but can be formed of any other material known in the art including plastic. As best shown in FIG. 2, connecting bar 10 is welded to support rails 4 and 6 at 12 such that end portions 14 (only one of which is clearly depicted in these figures) extend laterally, outwardly beyond their respective support rails 4,6. Each end portion 14 of connecting bar 10 includes a longitudinally extending bore (not labeled) which is adapted to receive a connecting member 15 as will be more fully discussed below.

Sliding tray assembly 1 further includes a pair of connecting brackets 18, each of which includes a base 20 from which extends a pair of clamping members 22. Clamping members 22 are generally spring-like and are adapted to extend about a support member (not shown in these figures) to which sliding tray assembly 1 is to be attached. Clamping members 22 terminate in a tab portion 25 which are adapted to be connected together by any means known in the art such as a bolt 28. Each connecting bracket 18 is secured to a respective end portion 14 of connecting bar 10 by connecting member 15. In the preferred embodiment, connecting member 15 comprises a bolt which is threaded into base 20 of its respective connecting bracket 18.

Fixedly mounted upon support rails 4 and 6 are a pair of guide rails 32,34 respectively. In the preferred embodiment, guide rails 32,34 are also formed from metal and are welded at selected locations along the length of support rails 4,6. Each guide rail 32,34 includes an elongated top portion 37, an elongated bottom portion 39 and a side wall portion 41. Each guide rail 32,34 is generally U-shaped in cross-section and defines an elongated channel 43. The elongated channels 43 of guide rails 32 and 34 are arranged such that they oppose one another as best shown in FIG. 1.

Each of the guide rails 32 and 34 are provided with at least one threaded aperture 48 that extends substantially perpendicular through elongated top portion 37 and opens into channel 43. In the preferred embodiment, two longitudinally spaced threaded apertures 48 and 50 are provided in each of the guide rails 32,34. Each of the threaded apertures 48,50 are adapted to receive a respective selective locking member 53,55. Each of the locking members 53,55 includes a threaded shaft portion 57 which terminates in a manually engageable knob 59.

Sliding tray assembly 1 further includes a tray 62 which, in the preferred embodiment, is formed from a plastic material. Tray 62 includes a support surface 65, angled side walls 67 and an outwardly extending, annular flange generally indicated at 69. Annular flange 69 includes a pair of opposing side sections 70 and 71 which are adapted to be slidably mounted within channels 43 of guide rails 32,34 such that tray 62 can be selectively positioned relative to support rails 4 and 6. The top surface 72 of each side section 70,71 are adapted to be engaged by the selective locking members 53,55 in order to secure tray 62 relative to guide rails 32 and 34 in various desired positions.

In use, sliding tray assembly 1 can be secured by means of connecting brackets 18 to a pair of spaced, substantially parallel support members (not shown in these figures) and tray 62 can be slidably adjusted within channels 43 of guide rails 32 and 34 to various operating positions. In addition, tray 62 can be fixed in any desired position relative to guide rails 32 and 34 by threading at least one of the locking members 53 and 55 within its respective aperture 48,50 so that the locking member(s) 53,55 engages top portion 72 of at least one of the opposing side wall sections 70 and 71.

Figure 3:
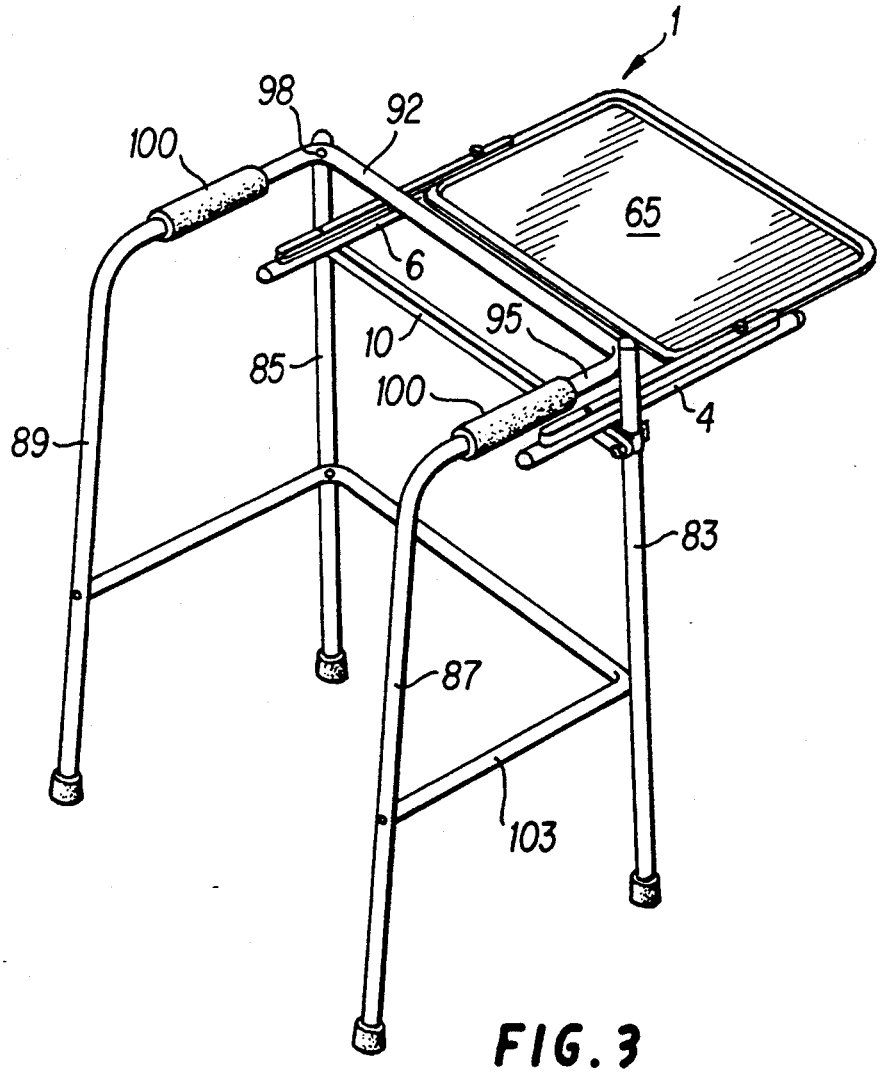
FIG. 3 shows the tray assembly according to the present invention connected to a walker.
Figure 4:
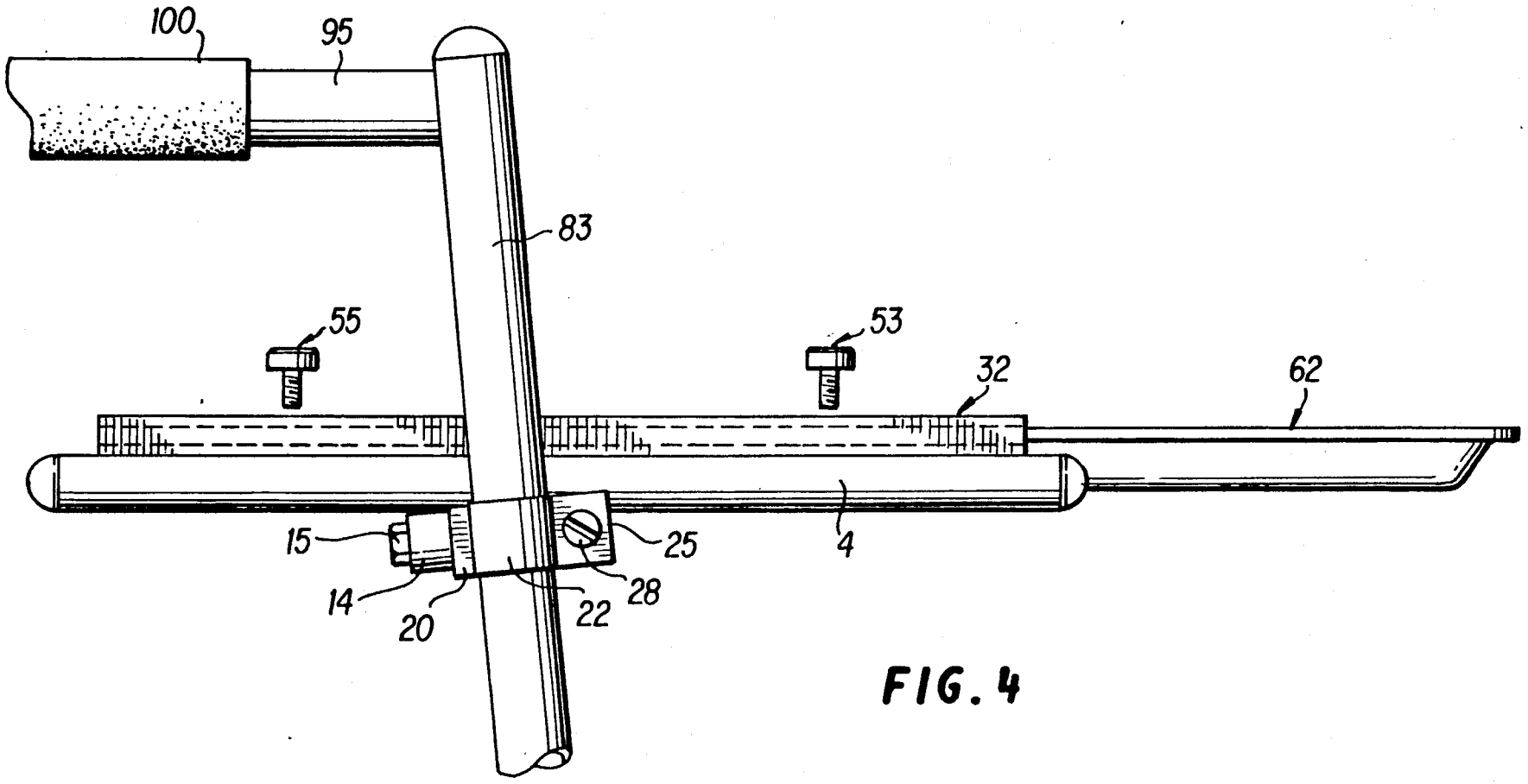
FIG. 4 depicts an enlarged side view of a portion of the walker and tray arrangement shown in FIG. 3.

The sliding tray assembly 1 of the present invention is particularly adapted to be used in combination with a walker 80 as depicted in FIGS. 3 and 4. Walker 80 includes a pair of spaced, substantially vertical front legs 83,85, a pair of spaced, substantially vertically extending rear legs 87,89, a front cross bar 92 and a pair of support bars 95,96. In the walker shown in FIG. 3, rear legs 87,89, support bars 95,96 and front cross bar 92 are formed as an integral member. Front legs 83,85 are secured at the junction of front cross bar 92 and support bars 95,96 by any means known in the art such as a screw or rivet generally shown at 98. Support bars 95 and 96 are adapted to be grasped by the hands of a user during use of walker 80 and, for this purpose, include a pair of cushioned gripping members 100. In addition, walker 80 can include a lower stabilizing bar 103 which further extends between and is interconnected with legs 83,85,87 and 89.

As shown in FIGS. 3 and 4, sliding tray assembly 1 is fixedly secured to the front legs 83,85 of walker 80 with each clamping member 22 extending about a respective one of the front legs 83,85 such that both support rails 4 and 6 and tray 62 are located in a substantially horizontal plane. Furthermore, as best shown in FIG. 4, sliding tray assembly 1 is secured to walker 80 such that a portion of each support rail 4,6 extends rearward of the front legs 83,85 while the remainder of each support rail 4,6 extends forward of the front legs 83,85. In the preferred embodiment, the portion of each support rail 4,6 that extends forward of the front legs 83,85 is longer than the rearwardly extending portion. This arrangement enables the sliding tray assembly to remain out of the way of the legs or body of a user of walker 80 while still permitting tray 62 to carry rather heavy objects. Furthermore, since tray 62 can slide within channels 43 of guide rails 32 and 34, tray 62 can be positioned extremely close to a person sitting in a chair such that, with sliding tray assembly 1 attached thereto, walker 80 can substantially function as a tray table.

Although described with respect to a preferred embodiment of the invention, it should be readily understood that various changes and/or modifications can be made to the invention without departing from the spirit thereof. For instance, it is possible to utilize the sliding tray assembly of the present invention in various other environments. In addition, it is further possible to integrate the guide channels with the support rails and utilize different types of connecting brackets, either carried by the connecting bar or the support rails, within the spirit of the invention. In general, the invention is only intended to be limited by the scope of the following claims.

I claim:

1. A sliding tray assembly for use in attaching to a pair of spaced, substantially vertical support members comprising:

a pair of spaced, substantially parallel support rails;

a connecting bar fixedly secured to and extending between said support rails, said connecting bar maintaining said support rails in the spaced, substantially parallel configuration;

a tray including opposing, outwardly extending flange portions;

means for removably attaching said tray to said support rails, said attaching means defining a pair of spaced, substantially parallel channels, each of said channels being carried by a respective one of said support rails and being adapted to slidably receive a respective one of said opposing flange portions; and means for fixedly mounting said tray assembly to a pair of spaced, substantially vertical support members.

2. A sliding tray assembly as claimed in claim 1, further including means for selectively, fixedly securing said tray within said channels.

3. A sliding tray assembly as claimed in claim 1, wherein said attaching means includes a pair of elongated guide rails, each of said guide rails being substantially U-shaped in cross-section and defining one of said channels, each of said guide rails being fixedly mounted upon a respective one of said support rails with the channel in one guide rail opposing the channel in the other guide rail.

4. A sliding tray assembly as claimed in claim 3, further including means for selectively, fixedly securing said tray within said channels.

5. A sliding tray assembly as claimed in claim 4, wherein each of said guide rails includes an elongated top portion, at least one of said top portions being provided with at least one aperture, and said securing means comprises a locking member which extends through said aperture and engages a respective one of said flange portions to prevent relative sliding movement between said tray and said guide rails.

6. A sliding tray assembly as claimed in claim 5, wherein said at least one aperture is threaded and said locking member comprises a shaft threadably received in said at least one aperture, said shaft terminating in a knob for manually adjusting said locking member.

7. A sliding tray assembly as claimed in claim 6, wherein each of said guide rails includes a plurality of spaced apertures each of which is adapted to threadably receive one of a plurality of threaded locking members in order to fixedly secure said tray in any one of a plurality of positions.

8. A sliding tray as claimed in claim 1, wherein said mounting means comprises a pair of clamping members which are attached to opposite end portions of said connecting bar and which are adapted to extend about and be clamped to a pair of spaced, substantially vertical support members respectively.

9. A sliding tray as claimed in claim 8, wherein said pair of clamping members comprises the sole mounting means for said tray assembly.

10. A sliding tray assembly in combination with a walker having a pair of spaced, substantially vertical leg members comprising:

a pair of spaced, substantially parallel support rails;

a connecting bar fixedly secured to and extending between said support rails, said connecting bar maintaining said support rails in the spaced, substantially parallel configuration;

a tray including opposing, outwardly extending flange portions;

means for removably attaching said tray to said support rails, said attaching means defining a pair of spaced, substantially parallel channels, each of said channels being carried by a respective one of said support rails and being adapted to slidably receive a respective one of said opposing flange portions; and means for fixedly mounting said tray assembly to said pair of spaced, substantially vertical support members of said walker.

11. A sliding tray assembly as claimed in claim 10, further including means for selectively, fixedly securing said tray within said channels.

12. A sliding tray assembly as claimed in claim 10, wherein said attaching means includes a pair of elongated guide rails, each of said guide rails being substantially U-shaped in cross-section and defining one of said channels, each of said guide rails being fixedly mounted upon a respective one of said support rails with the channel in one guide rail opposing the channel in the other guide rail.

13. A sliding tray assembly as claimed in claim 12, further including means for selectively, fixedly securing said tray within said channels.

14. A sliding tray assembly as claimed in claim 13, wherein each of said guide rails includes an elongated top portion, at least one of said top portions being provided with at least one aperture, and said securing means comprises a locking member which extends through said aperture and engages a respective one of said flange portions to prevent relative sliding movement between said tray and said guide rails.

15. A sliding tray assembly as claimed in claim 14, wherein said at least one aperture is threaded and said locking member comprises a shaft threadably received in said at least one aperture, said shaft terminating in a knob for manually adjusting said locking member.

16. A sliding tray assembly as claimed in claim 15, wherein each of said guide rails includes a plurality of spaced apertures each of which is adapted to threadably receive one of a plurality of threaded locking members in order to fixedly secure said tray in any one of a plurality of positions.

17. A sliding tray as claimed in claim 10, wherein said mounting means comprises a pair of clamping members which are attached to opposite end portions of said connecting bar and which extend about and are clamped to said pair of spaced, substantially vertical support members respectively.

18. A sliding tray as claimed in claim 17, wherein said pair of clamping members comprises the sole mounting means for said tray assembly to said walker.

19. A sliding tray assembly in combination with a walker as claimed in claim 10, wherein said walker comprises a pair of front legs, a pair of rear legs, a pair of substantially horizontally extending arm support members and means for interconnecting said legs and arm support members into an integral walker unit, said tray assembly being fixedly secured between and to said front legs by said mounting means with a first portion of each of said support rails extending rearward of said front legs and a second portion of each of said support rails extending forward of said front legs.

20. A sliding tray assembly in combination with a walker as claimed in claim 19, wherein the second portion of each of said support rails is longer then the first portion thereof.

* * * * *